US006332548B1

(12) United States Patent
West et al.

(10) Patent No.: US 6,332,548 B1
(45) Date of Patent: Dec. 25, 2001

(54) ADJUSTABLE SHELVING APPARATUS

(75) Inventors: Robert A. West, Shorewood; W. Gregory Coward, Wayzata, both of MN (US)

(73) Assignee: Westerlund Products Corporation, Minnetonka, MN (US)

( * ) Notice: Subject to any disclaimer, the term of this patent is extended or adjusted under 35 U.S.C. 154(b) by 30 days.

(21) Appl. No.: 09/624,168

(22) Filed: Jul. 24, 2000

Related U.S. Application Data

(62) Division of application No. 09/017,445, filed on Feb. 2, 1998, now Pat. No. 6,142,321.

(51) Int. Cl.[7] ..... A47F 5/00
(52) U.S. Cl. ..... 211/175
(58) Field of Search ..... 211/43, 42, 90.02, 211/175; 108/137, 102

(56) References Cited

U.S. PATENT DOCUMENTS

| | | | | |
|---|---|---|---|---|
| D. 355,551 | | 2/1995 | McNamara et al. | D6/511 |
| 563,467 | * | 7/1896 | Farwell . | |
| 770,262 | * | 6/1904 | Burke | 211/43 |
| 934,148 | * | 9/1909 | Duff . | |
| 2,294,595 | * | 9/1942 | Dice | 211/43 |
| 2,545,844 | * | 3/1951 | Cougais | 211/43 |
| 2,888,305 | * | 5/1959 | Perry | 211/175 |
| 4,036,369 | | 7/1977 | Eisenberg | 211/88 |
| 4,478,337 | | 10/1984 | Flum | 211/49 |
| 4,553,523 | * | 11/1985 | Stohrer, Jr. | 211/175 |
| 5,295,596 | * | 3/1994 | Squitieri | 211/43 |
| 5,553,824 | * | 9/1996 | Dutra, Jr. | 211/43 |
| 5,762,208 | * | 6/1998 | Yeh | 211/43 |
| 6,021,908 | | 2/2000 | Mathews | 211/90.2 |
| 6,142,321 | * | 11/2000 | West | 211/153 |

FOREIGN PATENT DOCUMENTS 178984 5/1922 (GB) .

* cited by examiner

*Primary Examiner*—Alvin Chin-Shue
*Assistant Examiner*—Sarah Purol
(74) *Attorney, Agent, or Firm*—Schwegman, Lundberg, Woessner & Kluth, P.A.

(57) ABSTRACT

A shelving apparatus is provided having a first set of cross members and a second set of cross members which are adapted to slidably couple with one another to form an adjustable shelf. Both sets of cross members have single or plurality of corresponding projecting and female surfaces such that the male surfaces of the first set of cross members are slidably received by the female surface of the second set of cross members. The cross members, which are formed from light-weight material, have a cavity therein which assists in making the shelving apparatus strong and light weight. A support bracket is also provided for additional strength for the shelving apparatus.

6 Claims, 13 Drawing Sheets

ADJUSTABLE SHELVING APPARATUS

This application is a divisional of U.S. Ser. No. 09/017,445, filed Feb. 2, 1998 Now U.S. Pat. No. 6,142,321.

FIELD OF THE INVENTION

The present invention relates generally to closet organization systems. More particularly, it pertains to an adjustable shelf for use with an organization system.

BACKGROUND OF THE INVENTION

As the emphasis on organization increases, consumers, and builders, are looking to make more efficient use of closet storage space to facilitate access to articles, and to permit a greater number of clothing articles to be stored in a given area. More complicated approaches to closet organization employ sophisticated modules that add shelves, shoe racks and the like to the conventional clothes rod. One approach involves coated wire shelving which is customized for each individual closet by the installer. The closet is measured, and then the wire shelving is cut to fit within the closet. To install the wire shelving, placement of the holes is measured and marked on the wall, holes are then drilled. Next, several small clips and mollies are attached to the wall using screws inserted into the pre-drilled holes. This approach, however, has several drawbacks. The rough edges, if not properly covered, snag and ruin clothing. In addition, the cut edges tend to rust, mildew, and mold, which also can potentially damage clothing, and mar the walls.

Another approach involves providing customized dressers and shelving made from wood, painted boards, and laminates, in combination with large wall sections which are professionally installed in a closet. These organizers are costly, and cannot be easily disassembled and/or reused in another configuration or closet.

The largest drawback to conventional closet organizers is that they tend to be difficult to install without prior experience and several tools. Levels, saws, tape measures, pliers, wrenches, adhesives, screws and drills may be required to install the conventional closet organizers. One miscut or mismeasurement may ruin all or a portion of the closet system. Baseboards must be pried from the walls, causing damage to the walls and requiring repair and painting. Another drawback is that long shelves are difficult to fit through the closet door. In addition, the installer may mar the walls as the long shelves are carried through a house prior to installation due to the awkwardness of carrying the long pieces of material. Laminates are also very heavy and difficult to move.

Accordingly, what is needed is a cost-effective adjustable shelving system that increases the useful space in an area, which is easy to assemble and disassemble. What is further needed is a shelving system which will not damage clothing or articles placed thereon. What is also needed is a shelving system which requires no precise measurements to be taken.

SUMMARY OF THE INVENTION

An adjustable shelving apparatus for use with organization systems is provided. In one embodiment, the shelving apparatus has a first set of cross members slidably engaged with a second set of cross members. Each of the cross members have a projecting male surface and a receiving female surface which form the sliding connection between the cross members. The female surfaces have a female component therein which engages with a male component provided, in one embodiment, on the projecting male surfaces, where the female component extends substantially the entire length of the cross members. In one embodiment, at least two male components are formed on the male surfaces. In another embodiment, the male surfaces are frictionally engaged with the female surfaces to prevent inadvertent disassembly of the cross members. When the cross members are coupled together, they form an adjustable shelf which provides a generally flat storage space thereon, and which can be adjusted in length to fit within varying sized closets. For additional support, a support bracket can also be provided with the adjustable shelving.

In another configuration, an adjustable shelving apparatus is provided which has at least one first cross member and at least one second cross member to form a substantially flat storage surface. The first cross member has a cut out to slidably receive substantially all of the second cross member therein. The first cross member has a track which extends substantially the same length as the cross member. The track receives a guiding projecting component on the second cross member such that the first cross member is slidably engaged with the second cross member to form an adjustable shelf. Alternatively, in another embodiment, the track is formed on the second cross member and the guiding projecting is formed on the first cross member. A support bracket can be coupled with the adjustable shelving apparatus for additional support.

The provided adjustable shelving provides several advantages since the shelving apparatus can accommodate many different closets having different widths. This provides a user the added benefit of not having to worry about accurate measurement prior to purchasing the shelving. In addition, a user does not need to cut the shelving to fit, which is desirable since no cutting tools are necessary during the installation process. Eliminating the cutting process from the installation of the shelving also eliminates jagged edges at the ends of the shelves, which can snag and damage clothing. The adjustable shelf also eliminates the frustration of making mistakes in cutting the shelving material. Another benefit is that the shelving can be made from recycled materials, and themselves be recycled.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the spirit and scope of the present invention. Therefore, the following detailed description is not to be taken in a limiting sense, and the scope of the present invention is defined by the appended claims.

Figure 1:
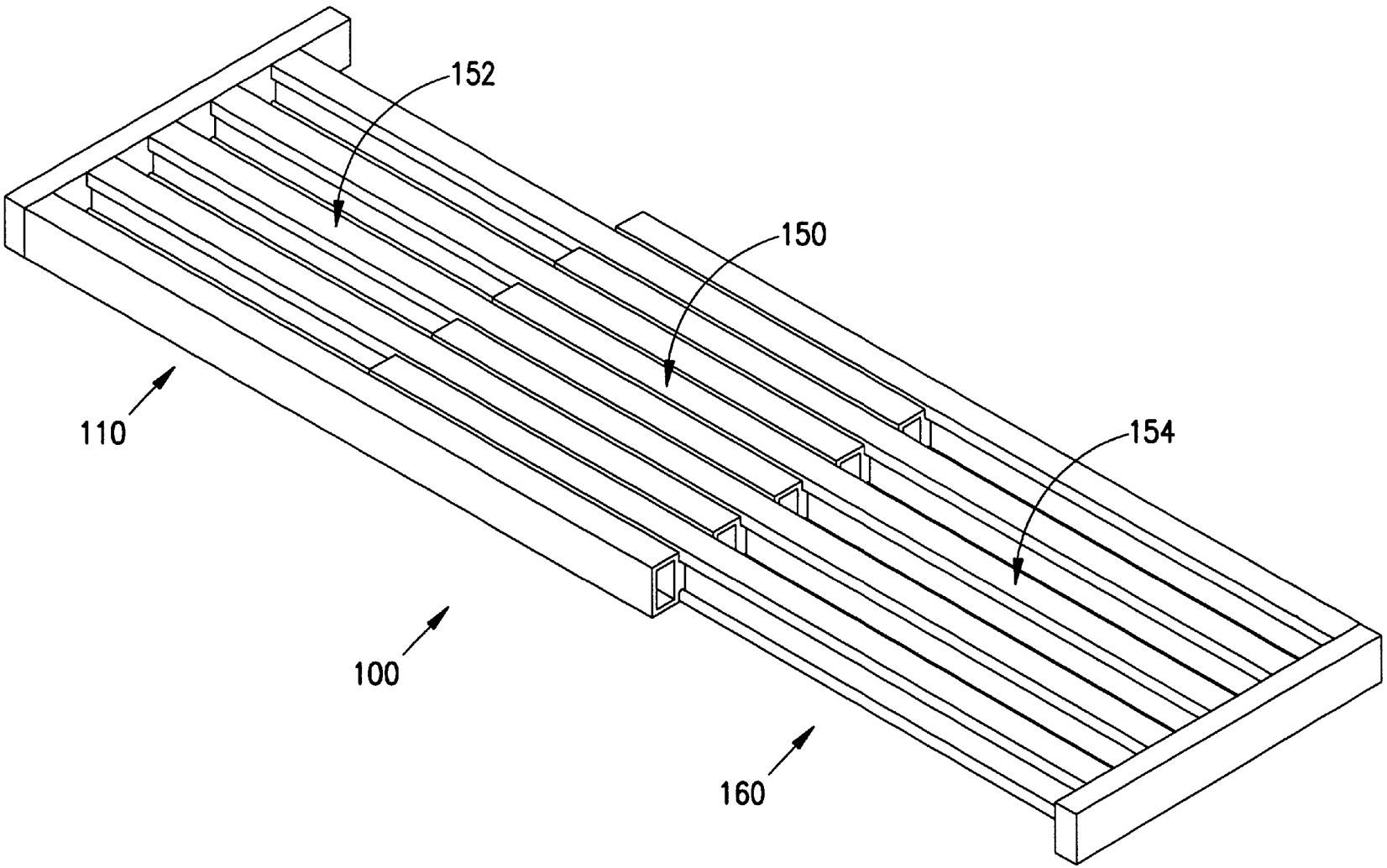
FIG. 1 is a perspective view illustrating a shelving apparatus constructed in accordance with one embodiment of the present invention.

FIG. 1 illustrates a first embodiment of the present invention. A shelving apparatus 100 is provided which comprises a first set of cross members 110 and a second set of cross members 160. The first set of cross members 110 slidably engage with the second set of cross members 160, as will be further described below, to form a shelving area. In one embodiment, the first set of cross members 110 and the second set of cross members 160 couple together to form a shelving area of a substantially solid, planar surface 150 and also vented surfaces 152, 154.

Figure 2:
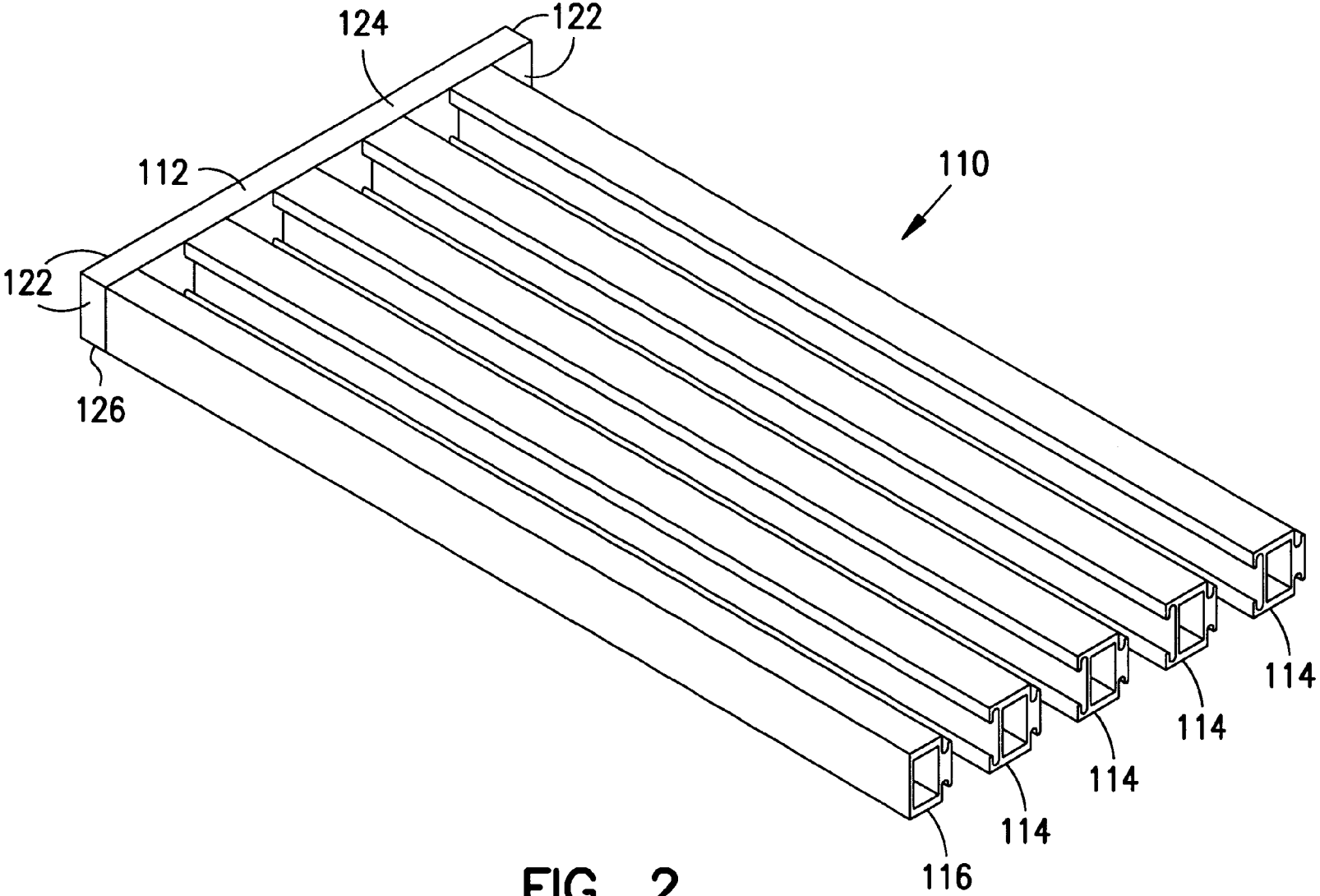
FIG. 2 is a perspective view illustrating a portion of a shelving apparatus constructed in accordance with one embodiment of the present invention.

FIG. 2 illustrates the first set of cross members 110 in closer detail. The first set of cross members 110 have, in one embodiment, individual cross members 114 and an end cross member 116. The first set of cross members 110 can also be comprised of individual cross members 114 alone. The cross members 114 and the end cross member 116 are each joined with a mounting bracket 112. The cross members 114 and the end cross member 116 can be joined with the mounting bracket 112 in a number of manners. For instance, in one embodiment, the cross members 114 and the end cross member 116 are joined with the mounting bracket 112 using a mechanical component such as a threaded fastener or a nail, or connected using a mortise and tenon arrangement. Alternatively, the cross members 114 and the end cross member 116 can be joined with the mounting bracket 112 using adhesive or ultrasonic welding. In yet another embodiment, the end cross member 116, the cross member 114 and the mounting bracket 112 can all be formed integrally out of a solid piece of material.

The mounting bracket 112 has side surfaces 122, a top surface 124, and a bottom surface 126. Although the terms "side, top and bottom" are used, the terms are merely used to describe the mounting bracket 112. The terms are not intended to limit the orientation of the mounting bracket 112 in any manner. The first set of cross members 110 are coupled with one of the side surfaces 122 of the mounting bracket 112. The mounting bracket 112 may also contain features which allow the mounting bracket 112 to be secured to a wall or another shelving unit, as will be further discussed below.

Figure 3:
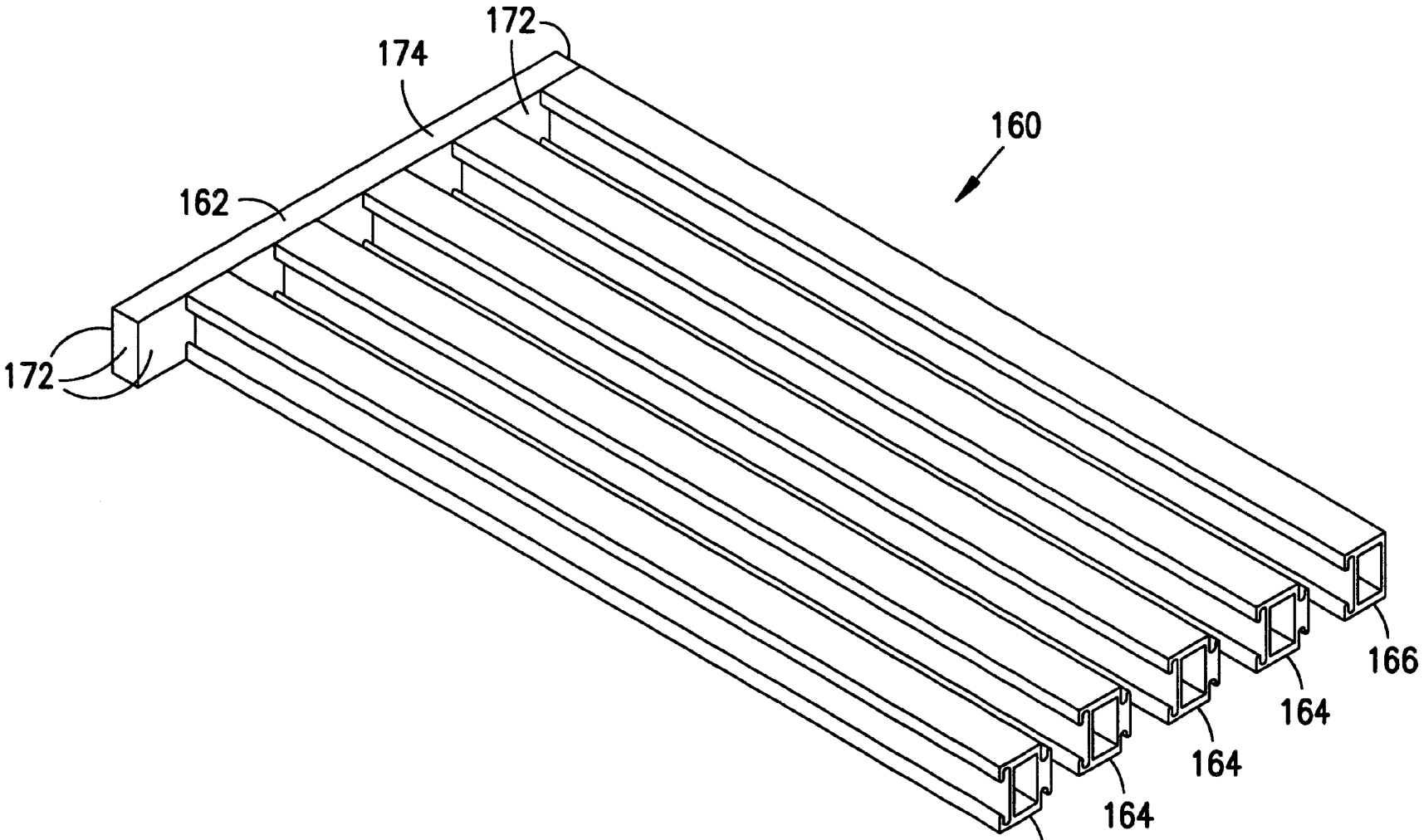
FIG. 3 is a perspective view illustrating another portion of the shelving apparatus constructed in accordance with one embodiment of the present invention.

FIG. 3 illustrates the second set of cross members 160 in closer detail. The second set of cross members 160 have, in one embodiment, individual cross members 164 and an end cross member 166. The second set of cross members 160 can also be comprised of individual cross members 164 alone. The cross members 164 and the end cross member 166 are each joined with a mounting bracket 162. The cross members 164 and the end cross member 166 can be joined with the mounting bracket 162 in a number of manners. For instance, in one embodiment, the cross members 164 and the end cross member 166 are joined with the mounting bracket 162 using a mechanical component such as a screw or a nail, or connected using a mortise and tenon arrangement. Alternatively, the cross members 164 and the end cross member 166 can be joined with the mounting bracket 162 using adhesive. Alternatively, the end cross member 166 and the cross member 164 and the mounting bracket 162 can all be formed integrally out of a solid piece of material.

The mounting bracket 162 has side surfaces 172, a top surface 174, and a bottom surface (not shown). Although the terms "side, top and bottom" are used, the terms are merely used to describe the mounting bracket 162. The terms are not intended to limit the orientation of the mounting bracket 162 in any manner. The set of cross members 160 are coupled with one of the side surfaces 172 of the mounting bracket 162. The mounting bracket 162 may also contain features which allow the mounting bracket to be secured to a wall or another shelving unit, as will be further discussed below.

Figure 4B:
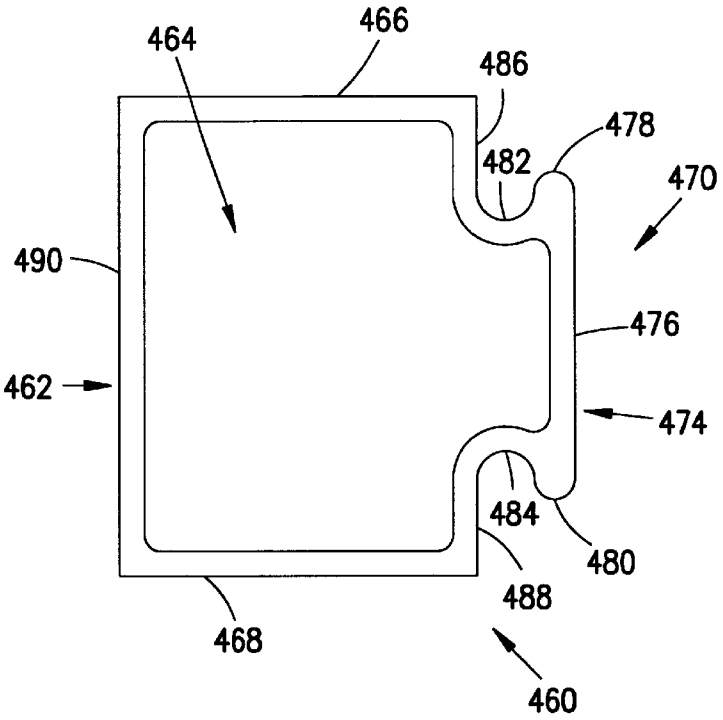
FIG. 4B is a first side elevational view illustrating a shelving apparatus constructed in accordance with one embodiment of the present invention.
Figure 4A:
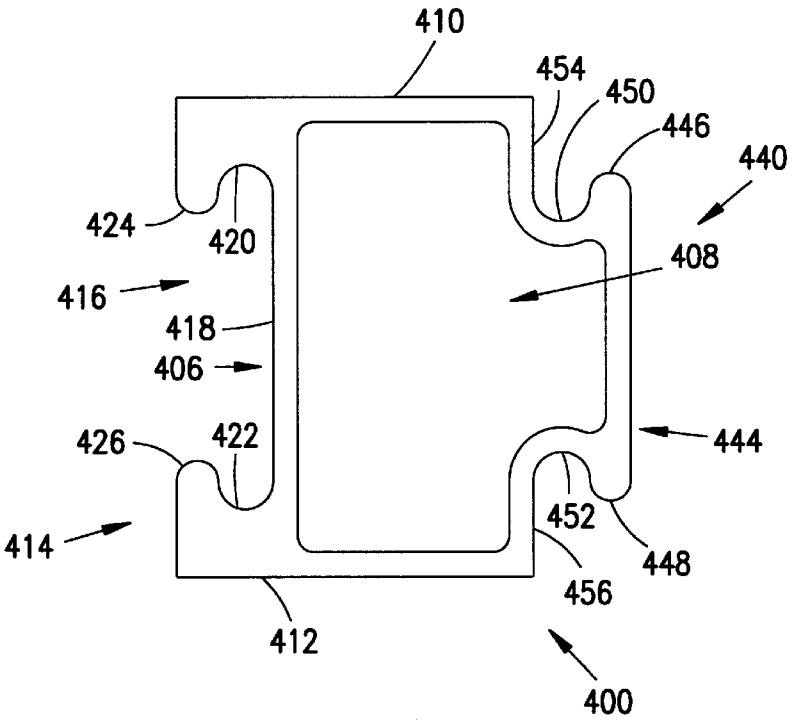
FIG. 4A is a first side elevational view illustrating a shelving apparatus constructed in accordance with one embodiment of the present invention.

FIGS. 4A and 4B show cross member profiles for both the cross member 400 and an end cross member 460, which are shown in FIG. 1 as the first set of cross members 110. The cross member profile, in one embodiment comprises a thin wall 406 which forms a cavity 408 therein. The cross member profile also has a top surface 410, a bottom surface 412, a first side surface 414, and a second side surface 440. Although the terms "top," "bottom," and "side" are used, the terms are merely used to describe the various features of the cross member profile, and are not intended to limit the orientation of the cross member 400 in any manner.

In one embodiment, the first side surface 414 has a socket 416 therein. The socket 416 forms a female component which receives other portions of other cross members 400, which will be further described below. Within the socket 416, which in one embodiment extends substantially the entire length of the cross member 400, is an inner surface 418. Specifically, the socket 416, in one embodiment, is defined by the inner surface 418, a first arcuate recess 420, a second arcuate recess 422, a first arcuate projection 424, and a second arcuate projection 426. In another embodiment, the first arcuate recess 420 and the first arcuate projection 424 are proximate to one another such that the socket 416 has a wider cutout proximate the inner surface 418 and then narrows toward the first side surface 414.

The second side surface 440 is further defined by a male component 444 which extends therefrom. In one embodiment, the male component 444 extends substantially the entire length of the cross member 400. In yet another embodiment, the male component 444 is formed on a surface of the cross member other than the first side surface 414.

The male component 444 is defined, in one embodiment, by a first arcuate portion 446, a second arcuate portion 448, a first arcuate recess 450, and a second arcuate recess 452. In another embodiment, the second side surface 440 also has a first flat portion 454 and a second flat portion 456. The first and second arcuate recesses 450, 452 are disposed between the first arcuate portion 446 and the second arcuate portion 448 and the first flat 454 and the second flat 456, respectively. Having the first arcuate recess 450 and the second arcuate recess 452 disposed in this location gives the engaging male component 444 a rounded profile. Although the above description has been provided for the male component 444, other shapes can be incorporated and are contemplated by the scope of the present invention.

Figure 4C:
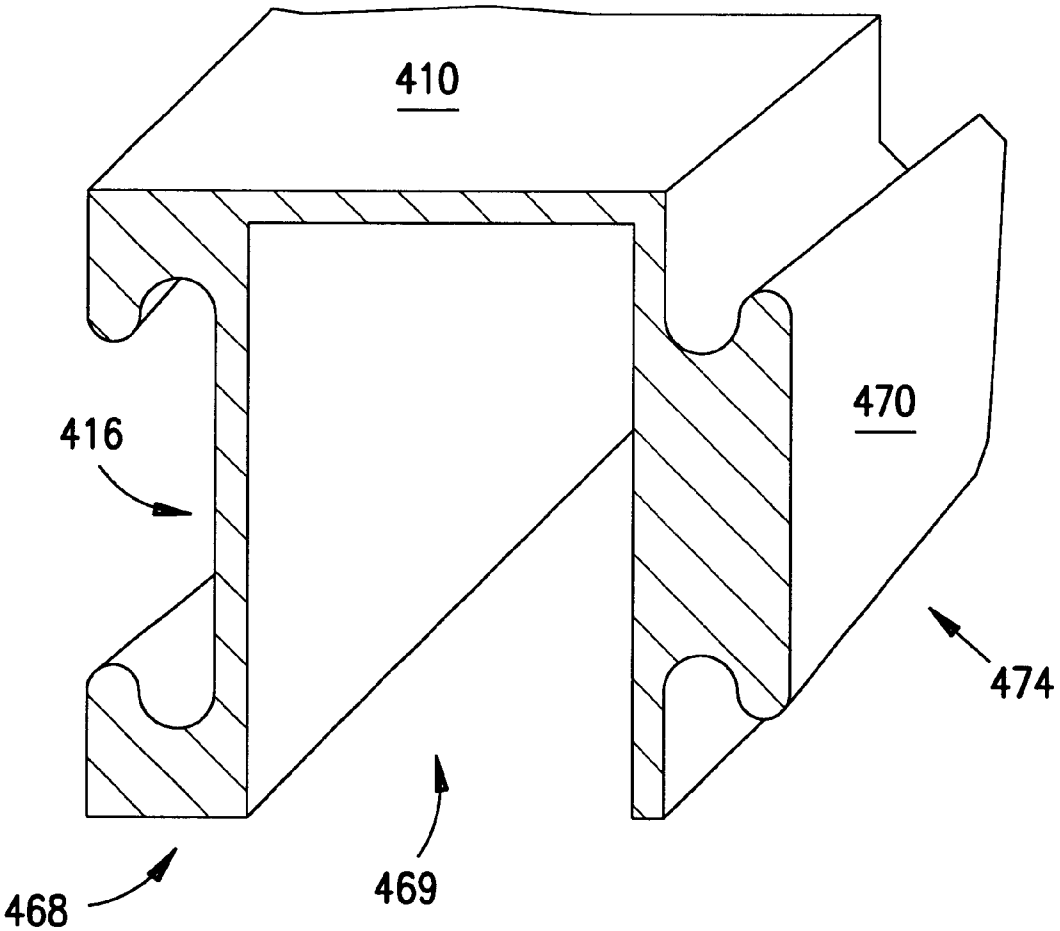

FIG. 4B illustrates the end member profile for the end cross member 460. In one embodiment, the profile has a thin wall portion 462 which forms a cavity 464 therein. Alternatively, in another embodiment, the end member profile can be formed from solid material with no cavity, or with a partial cavity. The cavity 464 assists in connecting the cross members with the mounting brackets, as discussed above. The cross member profile is, in one embodiment, defined by a top surface 466, a bottom surface 468, a first side surface 470, and a second side surface 490. Although the terms "top," "bottom," and "side" are used, the terms are merely used to describe the various features of the cross member profile, and are not intended to limit the orientation of the cross member 400 in any manner. In one embodiment, the top surface 466, the bottom surface 468, and the second side surface 490 are all generally flat. In another embodiment, the surfaces may be textured or have other profiles. In yet another embodiment shown in FIG. 4C, the bottom surface 468 can be open, forming a channel 469 therein. This type of configuration can be used on other embodiments of the cross member profiles. The first side surface 470 has an engaging male component 474.

As shown in FIG. 4B, the male component 474 is, in one embodiment, defined by an outer surface 476, a first arcuate portion 478, a second arcuate portion 480, a first arcuate recess 482 and a second arcuate recess 484. The first side surface 470 also has a first flat 486 and a second flat 488. The first arcuate recess 482 is disposed between the first arcuate portion 478 and the first flat 486. Similarly, the second arcuate recess 484 is disposed between the second arcuate portion 480 and the second flat 488 to give the engaging male component 474 a rounded profile. The profile, alternatively, can be provided with other shapes, which are considered within the scope of the invention. During use, the male component 474 is sized to be received by the socket 416, shown in FIG. 4A, as will be further described below.

Figure 5B:
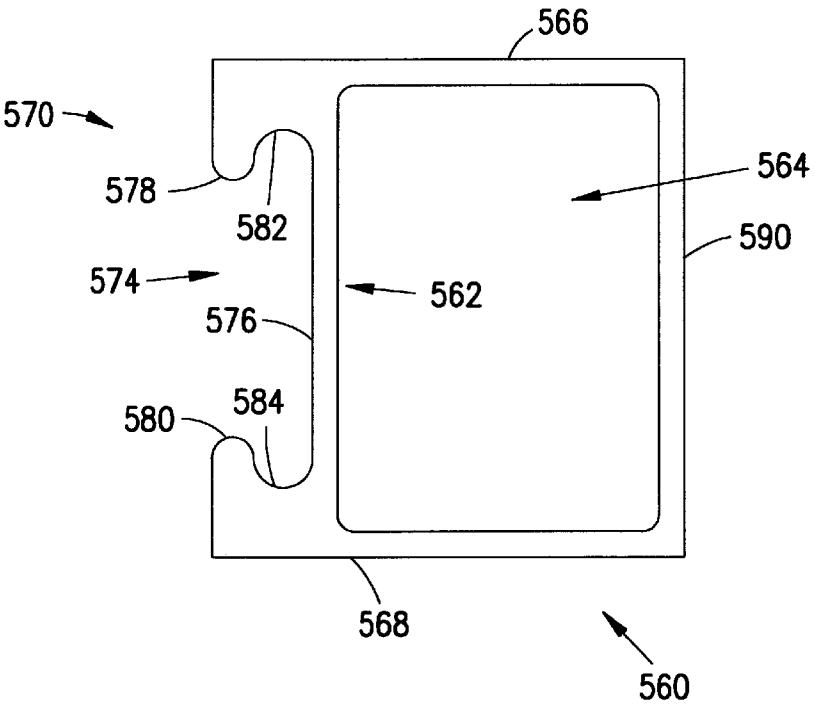
FIG. 5B is a first side elevational view illustrating a shelving apparatus constructed in accordance with another embodiment of the present invention.
Figure 5A:
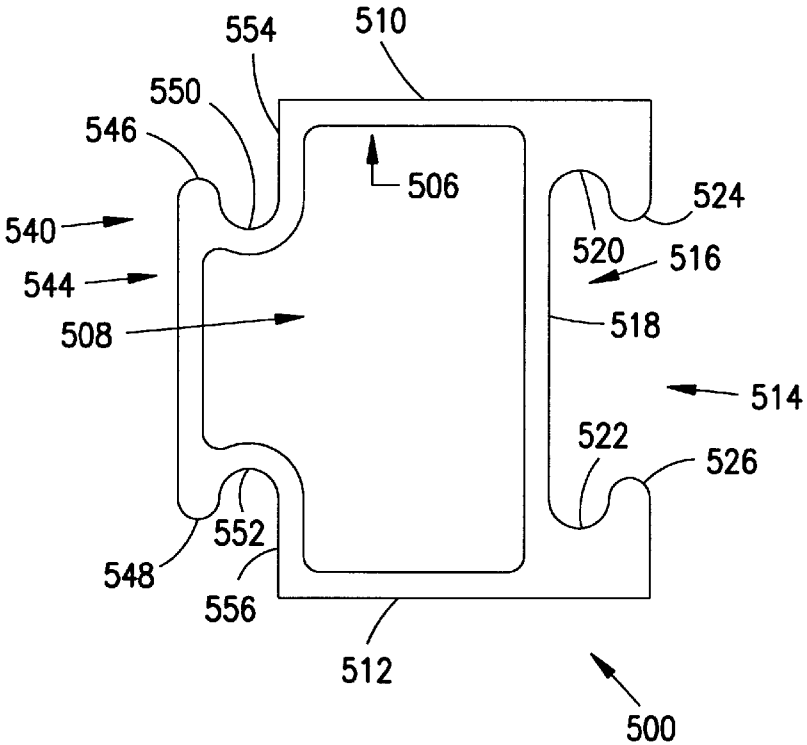
FIG. 5A is a first side elevational view illustrating a shelving apparatus constructed in accordance with another embodiment of the present invention.

FIGS. 5A and 5B illustrate one embodiment of cross member profiles for both the cross member 500 and an end cross member 560, which are shown in FIG. 1 as the second set of cross members 160. The cross member profile for this configuration has a thin wall 506 structure which forms a cavity 508 therein. The cross member profile also has a top surface 510, a bottom surface 512, a first side surface 514, and a second side surface 540. Although the terms "top," "bottom," and "side" are used, the terms are merely used to describe the various features of the cross member profile, and are not intended to limit the orientation of the cross member 500 in any manner.

The first side surface 514 has a socket 516 therein. The socket 516 receives other portions of other cross members 500, which will be further described below. Within the socket 516 is an inner surface 518. Specifically, the socket 516, in one embodiment, is defined by the inner surface 518, a first arcuate recess 520, a second arcuate recess 522, a first arcuate projection 524, and a second arcuate projection 526. In another embodiment, the first arcuate recess 520 and the first arcuate projection 524 are proximate to one another such that the socket 516 has a wider cutout proximate the inner surface 518 and then narrows toward the first side surface 514.

The second side surface 540 is further defined by a male component 544 which extends therefrom. The male component 544 is defined, in one embodiment, by a first arcuate portion 546, a second arcuate portion 548, a first arcuate recess 550, and a second arcuate recess 552. In another embodiment, the second side surface 540 also has a first flat portion 554 and a second flat portion 556. The first and second arcuate recesses 550, 552 are disposed between the first arcuate portion 546 and the second arcuate portion 548 and the first flat 554 and the second flat 556, respectively. Having the first arcuate recess 550 and the second arcuate recess 552 disposed in this position gives the engaging male component 544 a rounded profile. Although the above description has been provided for the engaging male component 544, other shapes for the engaging male component 544 can be incorporated and are contemplated by the scope of the present invention.

FIG. 5B illustrates the end member profile for the end cross member 560. In one embodiment, the profile has a thin wall portion 562 which forms a cavity 564 therein. Alternatively, in another embodiment, the end member profile can be formed from solid material with no cavity, or with a partial cavity. The cavity 564 assists in connecting the cross members with the mounting brackets, as discussed above. The cross member profile is, in one embodiment, defined by a top surface 566, a bottom surface 568, a first side surface 570, and a second side surface 590. Although the terms "top," "bottom," and "side" are used, the terms are merely used to describe the various features of the cross member profile, and are not intended to limit the orientation of the cross member 500 in any manner. In one embodiment, the top surface 566, the bottom surface 568, and the second side surface 590 are all generally flat. In another embodiment, the surfaces may be textured or have other profiles.

The first side surface 570 has a socket 574 therein. The socket 574 forms a female component which receives other portions of other cross members 400, which will be further described below. Within the socket 574 is an inner surface 576. Specifically, the socket 574, in one embodiment, is defined by the inner surface 576, a first arcuate recess 582, a second arcuate recess 584, a first arcuate projection 578, and a second arcuate projection 580. In another embodiment, the first arcuate recess 582 and the first arcuate projection 578 are proximate to one another, and the second arcuate recess 584 and the second arcuate projection 580 are proximate to one another such that the socket 574 has a wider cutout proximate the inner surface 576 and then narrows toward the first side surface 570 to form a socket 516 for a rounded flange to be received therein.

Figure 6:
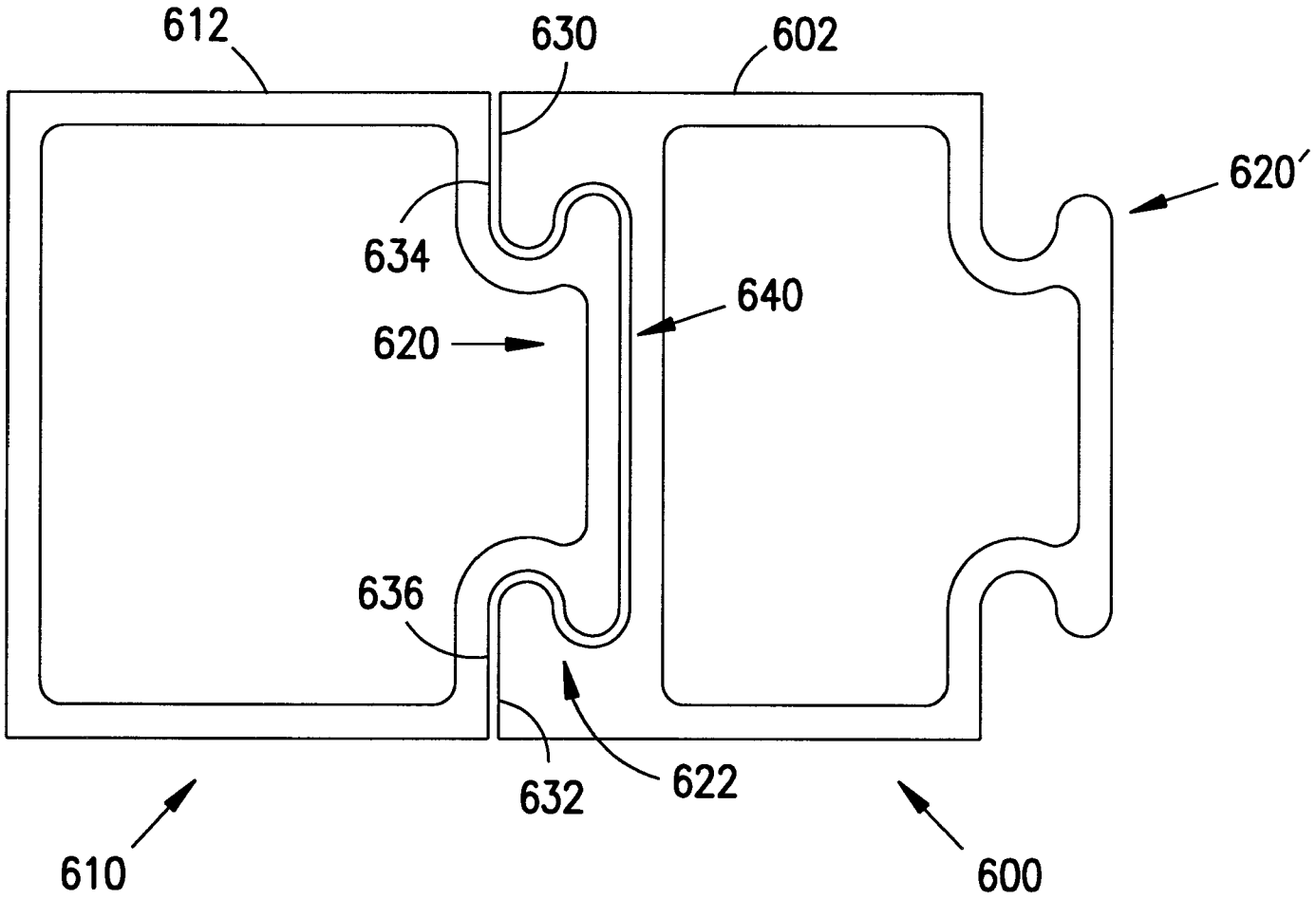
FIG. 6 is a first side elevational view illustrating a shelving apparatus constructed in accordance with yet another embodiment of the present invention.

FIG. 6 illustrates another embodiment of the present invention. An individual cross member 600 is shown coupled with an end cross member 610, which is how the cross members would be coupled, in one embodiment, during use of the shelving apparatus. The profiles shown in the Figure closely follow those illustrated in FIG. 1. The end cross member has a male component 620 thereon which couples with a socket 622 formed in the individual cross member 600, to form a tongue and groove coupling. The individual cross member 600 also has a male component 620' disposed thereon. The male component 620 is sized to be received by the socket 622, where the male component 620 slides within the socket 622 to thereby accommodate the varying lengths of shelves necessary for various closets or spaces. In one embodiment, the male component 620 couples with the socket 622 such that flats 630, 632 of the individual cross member 600 are proximately disposed to flats 634, 636 of the end cross member 610, respectively. The male component 620 couples with the socket 622 such that a top surface 602 of the individual cross member 600 lies substantially within the same plane of a top surface 612 of the end cross member 610. In addition, a gap 640 exists, in another embodiment, between the mating surfaces of the male component 620 and the socket 622. The gap 640 may vary in size according to various embodiments of this invention. In one embodiment, the gap 640 is sized such that the individual cross member 600 is held in frictional engagement with the end cross member 610. Having the frictional engagement provides the benefit of having the shelving system not inadvertently slip out of a user's hands and potentially damaging the shelving system, marring a wall, and/or injuring the user.

Figure 7:
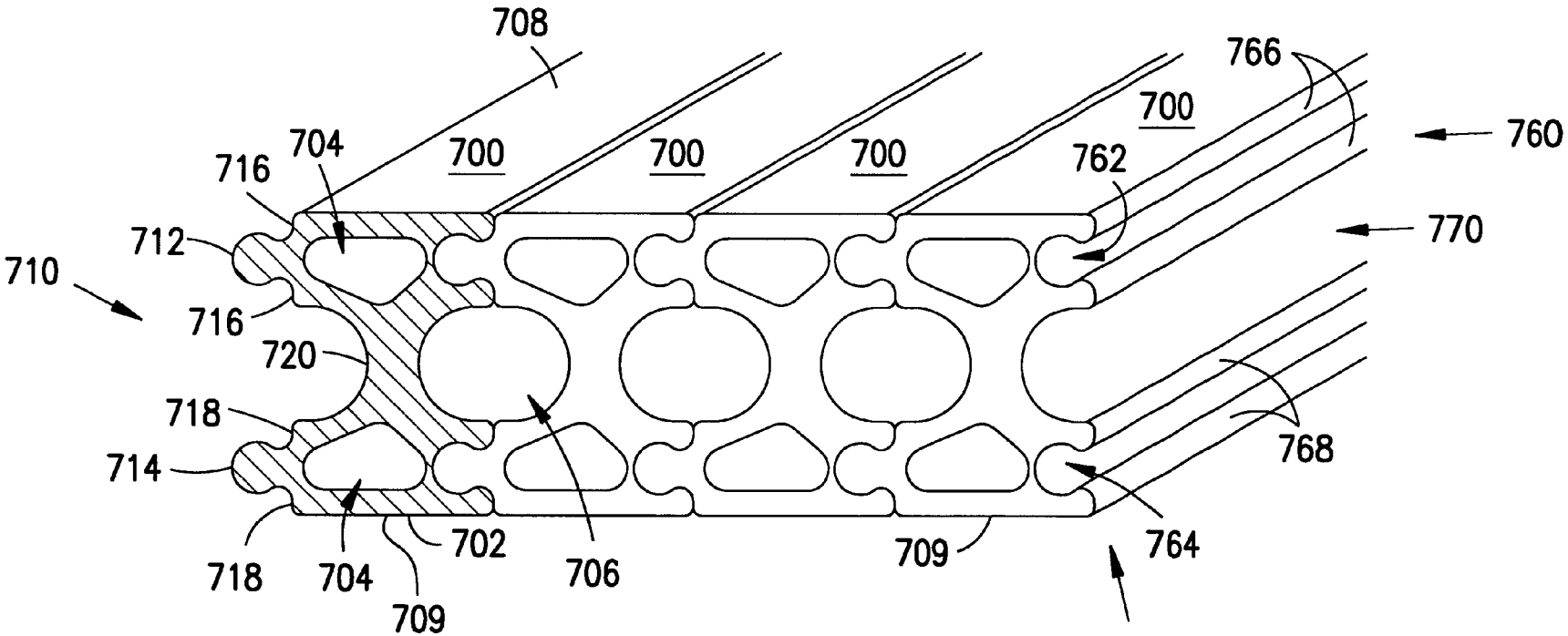
FIG. 7 is a perspective view illustrating a shelving apparatus constructed in accordance with another embodiment of the present invention.

FIG. 7 illustrates another embodiment of the present invention. A plurality of cross members 700 are shown having a profile. Each of the cross members 700, in one embodiment, have a male side surface 710 and a female side surface 760. Each male side surface 710 is adapted to be slidably coupled with each female side surface 760. Alternatively, in another embodiment, one of the male side surfaces 710 could have a flat, or substantially flat side surface which would not engage with a female side surface 760. In addition, in another configuration, one of the female side surfaces 760 could also have a flat, or substantially flat side surface which would not engage with a male side surface 710. Each of the flat side surfaces as just described, would serve as an end surface for the shelving apparatus.

The cross members 700 also have a top surface 708 and a bottom surface 709. Although the terms "top," "bottom," and "side" are used, the terms are merely used to describe the various features of the cross member profile, and are not intended to limit the orientation of the cross members 700 in any manner. In one embodiment, the top surface 708 and the bottom surface 709 are generally flat. In another embodiment, the surfaces may be textured or have other profiles. The cross members 700, in one embodiment, couple with one another such that all of the top surfaces 708 align to form a substantially flat surface. The bottom surface 709 of each cross member 700 can also form a substantially flat surface. However, each of the top surface 708 or the bottom surface 709 may have slight gaps in between the cross members 700. Alternatively, other configurations can also be provided for either the top surface 708 or the bottom surface 709 or both.

Referring to the projecting side surface 710, a first and second coupling male component 712, 714, in one embodiment, are provided thereon. Alternatively, in another embodiment, a plurality of male components can be provided on the male side surface 710. The first male component 712 has a rounded portion which extends to a first set of shoulders 716. Similarly, the second male component 714 also has a rounded portion which extends down to a second set of shoulders 718. Between the first male component 712 and the second male component 714, in yet another embodiment, is a depression 720. The depression 720 can take a variety of forms, although as shown in the Figure is generally curved. When the cross members 700 are coupled together, the depression 720 forms a hollow portion 706 in between the cross members 700.

Referring to the female side surface 760, a first embodiment is shown where a first recess 762, a second recess 764, and a second depression 770 are formed therein. The position and size for the first recess 762 and the second recess 764 are such that they can receive therein the first male component 712 and the second male component 714 of a male side surface 710, respectively. The shape and number of the recesses can be modified, depending on the embodiment, and correspond to the shape and number of the projections. A first set of flats 766 are disposed on either side of the first recess 762. In addition, a second set of flats 768 are disposed on either side of the second recess 764. The first set of flats 766 and the second set of flats 768 abut against or, in the alternative, are placed proximate to the first set of shoulders 716 and the second set of shoulders 718 of the projecting side surface 710, respectively, when the cross members 700 are coupled with one another.

The cross members 700, in yet another embodiment, are extruded from various thermoformed plastics to form an elongate structure. For instance, the cross member 700 can be formed from a rigid polyvinylchloride (RPVC), ABS plastic, and high-impact polystyrene plastic. Alternatively, the cross members 700 can be formed from other light weight materials such as wood or aluminum. In addition, the cross members 700 can also be formed from polymers with fungicide with provides a further advantage in preventing mildew and mold.

The cross members 700 are formed with a thin wall structure 702. The thin wall structure 702 also may have at least one cavity 704 therein, where the cavity 704 can be formed partially or fully through the cross members 700. Having the thin wall structure 702 and a plurality of cavities 704 therein assists in forming a lightweight structure for the shelving apparatus. In addition, the cavity 704 can assist in connecting the cross members 700 with a coupling member (not shown). The geometry of the profile, which can be modified, however, aids in the strength of the shelving apparatus in addition to the material selection.

Figure 8:
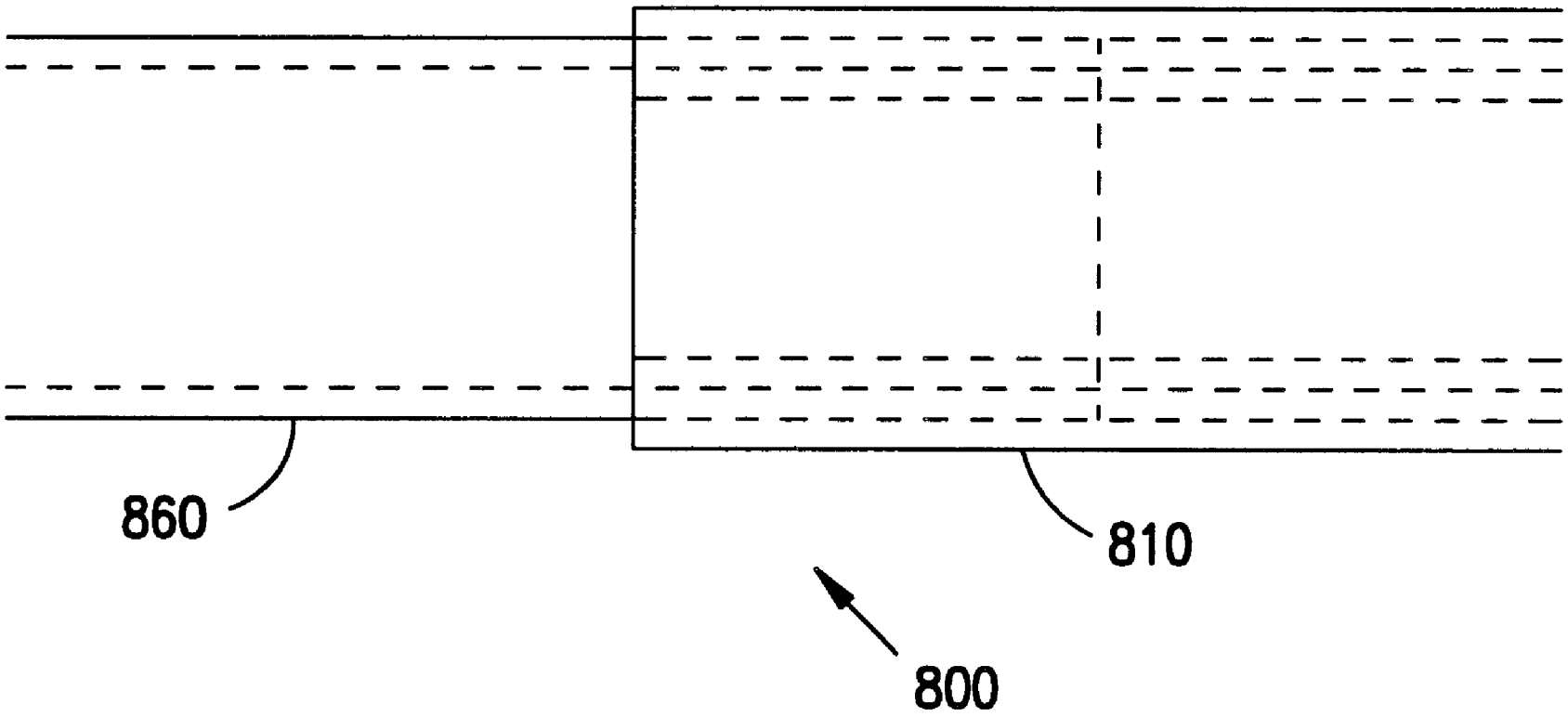
FIG. 8 is a top plan view illustrating a shelving apparatus constructed in accordance with one embodiment of the present invention.
Figure 9B:
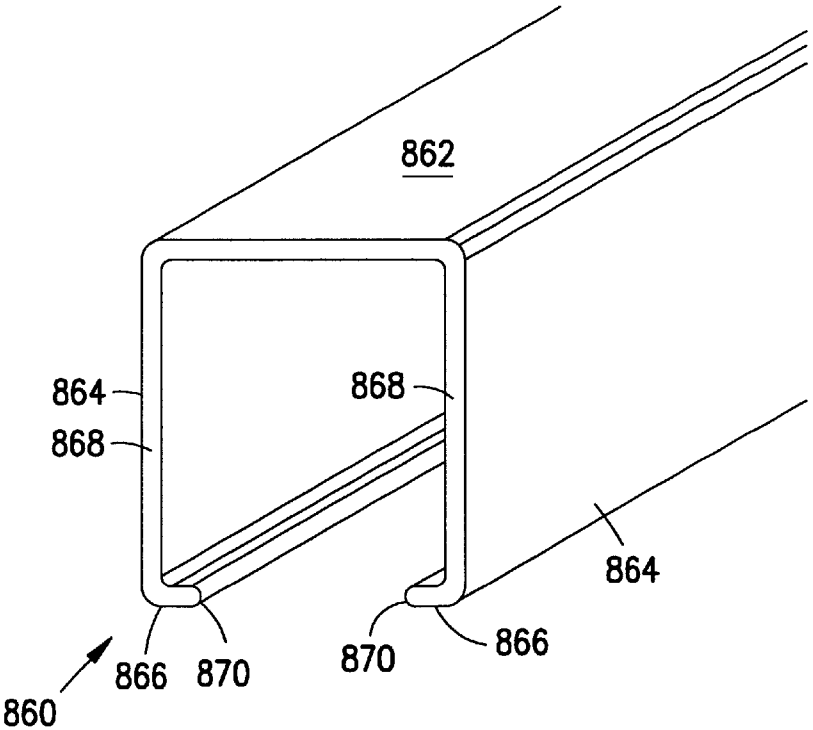
FIG. 9B is a perspective view illustrating a portion of a shelving apparatus constructed in accordance with another embodiment of the present invention.
Figure 9A:
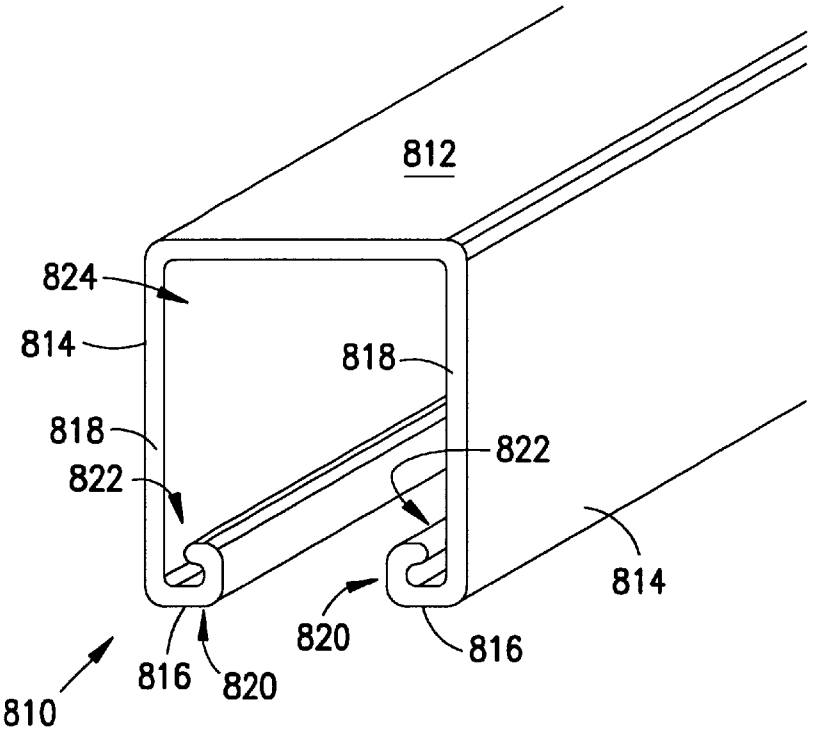
FIG. 9A is a perspective view illustrating a portion of a shelving apparatus constructed in accordance with another embodiment of the present invention.

FIGS. 8, 9A, and 9B illustrate another embodiment of the present invention. A shelving apparatus 800 is provided with a first cross member 810 and a second cross member 860. A single cross member 810 and second cross member 860 are illustrated for descriptive purposes of a first embodiment. However, in another embodiment, a plurality of first cross members 810 and a plurality of second cross members 860 can be used, as is described in the earlier embodiments, to form the shelving apparatus. The second cross member 860 is adapted to be received fully or partially within the first cross member 810 as shown in the Figure.

FIGS. 9A and 9B illustrate the first cross member 810 and the second cross member 860 in greater detail. The first cross member 810 is, in one embodiment, defined in part by a top surface 812, side surfaces 814, and a bottom surface 816. Although the terms "top," "side," and "bottom" are used, the terms are merely to describe the various components of the cross member 810 and are not intended to restrict the orientation of the cross member 810 in any manner. For each of the side surfaces 814, a sidewall 818 extends into a curved wall portion 820. The curved wall portion 820 forms a track 822 therein. The track 822 of the first cross member 810 is adapted to receive therein at least a portion of the second cross member 860 therein, as will be further described below. The track 822 can have other configurations, which are considered within the scope of the invention. For instance, in one embodiment, the track 822 extends substantially the same length as the cross member.

The first cross member 810 also has a cutout 824 therein. The cutout 824 allows for the second cross member 860 to be slidably inserted therein. The cutout 824 also allows for the first cross member 810 to be of lighter weight and provides a cost effective part since the thin wall structure of the first cross member 810 can be, for example, extruded.

Referring to FIG. 9B, the second cross member 860 is defined by a top surface 862, side surfaces 864, and a bottom surface 866. Although the terms "top," "side," and "bottom" are used, the terms are merely to describe the various components of the cross member 860 and are not intended to restrict the orientation of the cross member 860 in any manner. Each of the side surfaces 864 has a sidewall 868 which extends toward the bottom surface 866 to form a guiding projection 870 on each of the side surfaces 864. In one embodiment, the guiding projection 870 extends substantially the same length as the cross member. The guiding projection 870 has substantially the same profile as the track 822 of the first cross member 810 such that the second cross member 860 can be slidably received by the first cross member 810. In one embodiment, the track 822 and the guiding projection 870 are sized and shaped such that the second cross member 860 is frictionally engaged with the first cross member 810.

The first cross member 810 and the second cross member 860 each have a generally square shape. Alternatively, the cross members 810, 860 can have other profiles, such as rectangular, oval, or circular, and still be considered within the scope of the invention. In addition, while two track members have been described in addition to two fingers for each of the side surfaces, only one track and one finger would be necessary and is considered within the scope of the invention. In addition, a plurality of track and corresponding finger members can be used to guide the second cross member 860 within the first cross member 810. Alternatively, in another embodiment, the track 822 can be formed on the second cross member 860, and the guiding projection 870 can be formed on the first cross member 810.

Figure 10A:
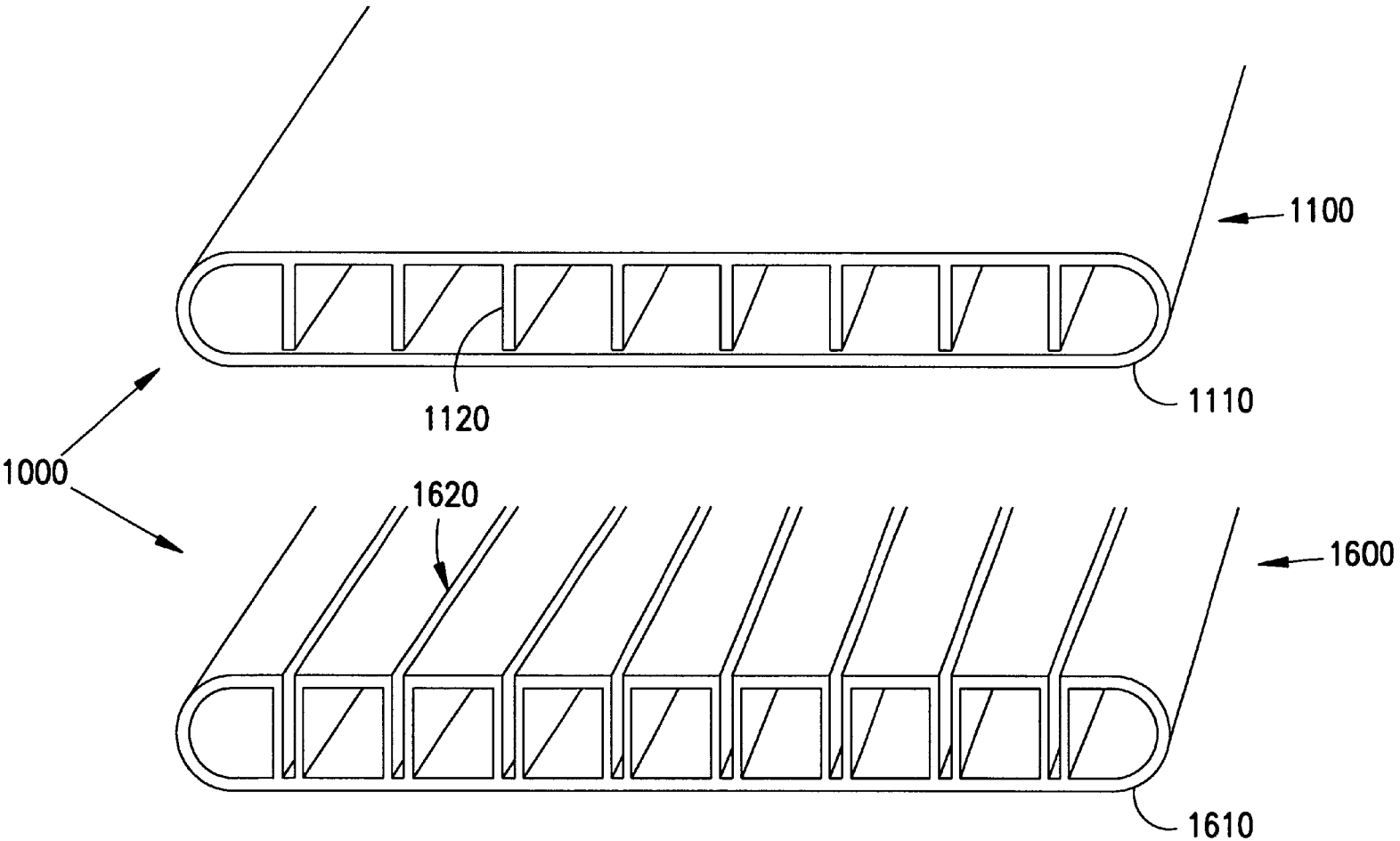
FIG. 10A is a perspective view illustrating a portion of a shelving apparatus constructed in accordance with another embodiment of the present invention.
Figure 10B:
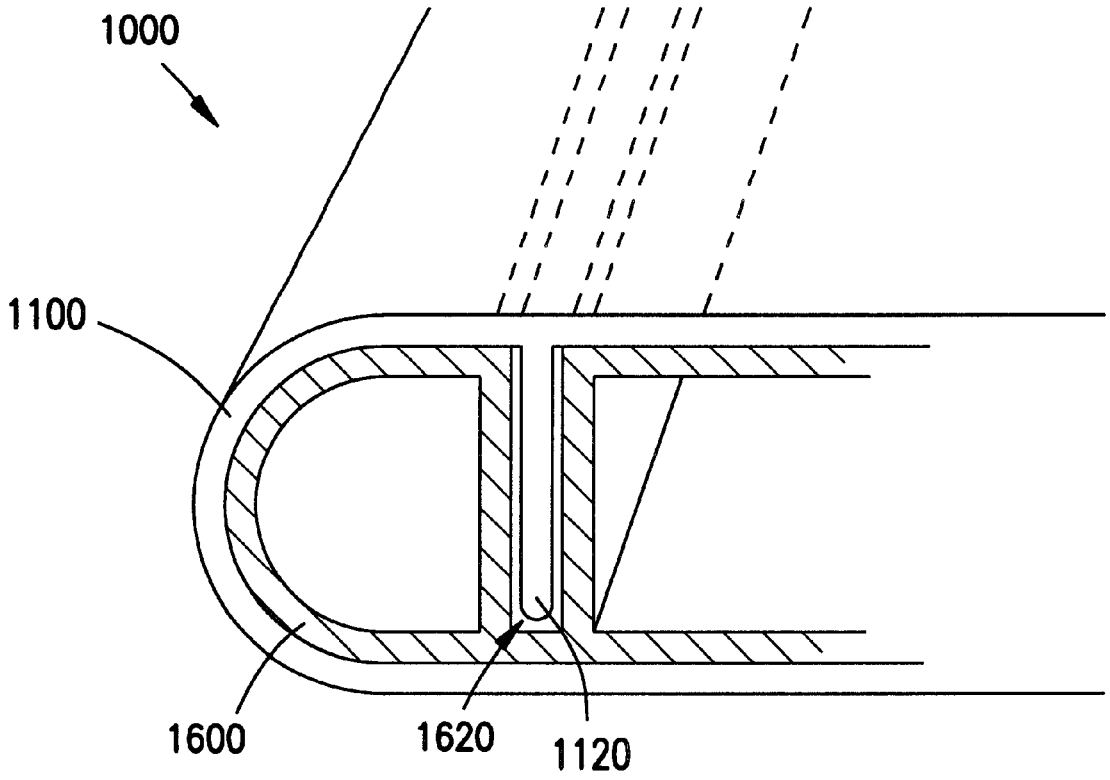
FIG. 10B is a cut-away view illustrating a portion of a shelving apparatus constructed in accordance with another embodiment of the present invention.

FIGS. 10A and 10B illustrate yet another embodiment of the present invention. A shelving apparatus 1000 is provided which comprises a first sliding member 1100 and a second sliding member 1600. The first sliding member 1100 slidably engages with the second sliding member 1600, as will be further described below, to form a shelving area. In one embodiment, the first sliding member 1100 and the second sliding member 1600 each have an oval shape. The first sliding member 1100 has a first housing 1110 which, in one embodiment, slidingly receives therein a second housing 1610 of the second sliding member 1600, as shown in FIG. 10B. In one embodiment, the first sliding member 1100 has a plurality of projections 1120. The second sliding member 1600, in this configuration, has a plurality of cut outs 1620 which receive the plurality of projections 1120 therein. The projections 1120 and the cut outs 1620, however, can be formed on the second sliding member 1600 and the first sliding member 1100, respectively.

Figure 11A:
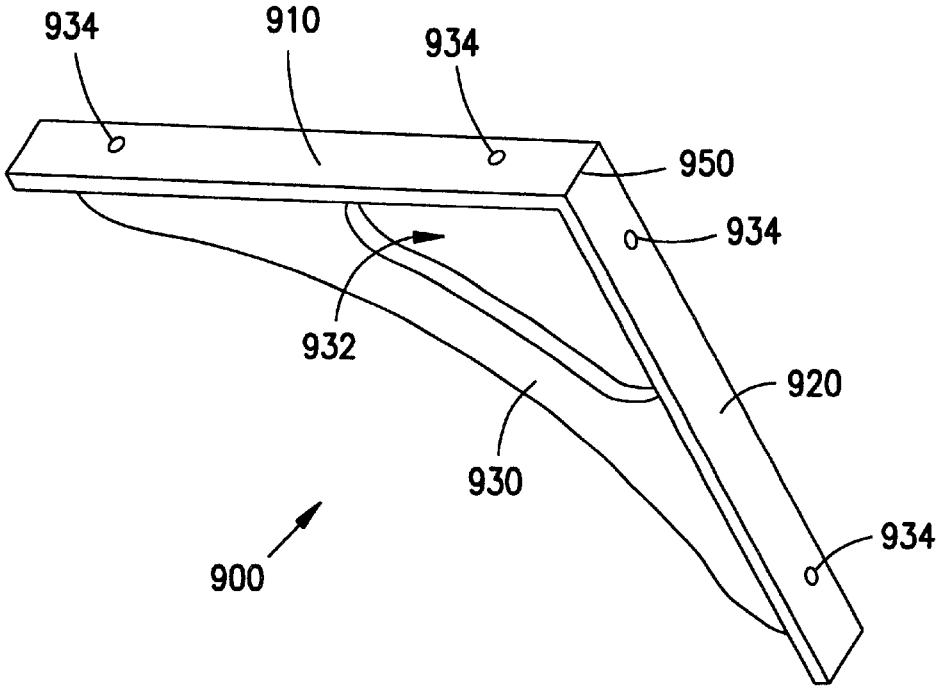
FIG. 11A is a perspective view illustrating a support bracket constructed in accordance with one embodiment of the present invention.
Figure 11B:
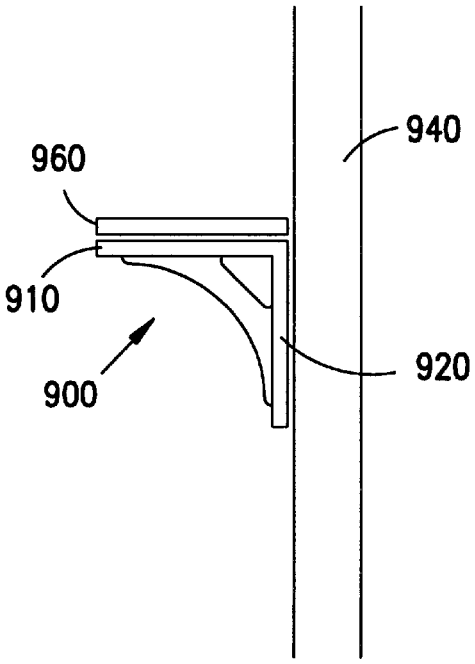
FIG. 11B is a first side elevational view illustrating a shelving system constructed in accordance with another embodiment of the present invention.

After cross members are slidably coupled with one another to form a shelving apparatus, it may be beneficial to add additional support structure when the shelving apparatus is used in places such as a closet, particularly if heavy objects are to be placed on the shelving apparatus. FIGS. 11A and 11B illustrate one example of a support bracket to be used in combination with the shelving apparatus. A support bracket 900 is shown having a first member 910 and a second member 920. The first member 910 is coupled with the second member 920 at an apex 950. In addition, a brace structure 930 in one embodiment is disposed between the first member 910 and the second member 920, forming a cavity 932 therein. The first member 910 is disposed at approximately a 90° C. angle to the second member 920, although other angles may also be desirable and are considered within the scope of the invention. The support bracket 900 is also provided with a plurality of apertures 934. In another configuration, only one aperture is provided to secure the support bracket 900 to a wall portion.

FIG. 11B illustrates a support bracket 900 in use with a shelving apparatus 960. The support bracket 900 is assembled such that the second member 920 is coupled with a wall portion 940. Retaining members, such as screws, can be used to secure the second member 920 with the wall portion 940. In another embodiment, the shelving apparatus 960 is coupled to the first member 910. In an alternative configuration, the shelving apparatus 960 can be coupled independently with a wall portion 940. The support bracket 900 advantageously provides additional support for the shelving apparatus 960 for situations where heavy objects are being placed upon the shelving apparatus 960.

Advantageously, the adjustable shelving can accommodate many different closets having different widths. This provides a user the added benefit of not having to worry about accurate measurement prior to purchasing the shelving. In addition, a user does not need to cut the shelving to fit, which is desirable since no cutting tools are necessary during the installation process, and the adjustable shelving is easy to assemble and disassemble. Once the adjustable shelving has been installed, it can easily be removed and modified to fit another space. Eliminating the cutting process from the installation of the shelving also eliminates jagged edges at the ends of the shelves, which can snag and damage clothing.

The adjustable shelf also eliminates the frustration of making mistakes in cutting or installing the shelving material, where no additional hardware is necessary to affix the components of the shelving together. Another benefit is that the shelving can be made from recycled materials, and themselves be recycled. The use of light weight material facilitates in the ease of assembly and disassembly, and is easily carried through a home. The plastic material allows for cleaning the shelving assembly with household cleaners.

It is to be understood that the above description is intended to be illustrative, and not restrictive. Many other embodiments will be apparent to those of skill in the art upon reviewing the above description. For instance, many other profiles for the cross members can be incorporated to provide the adjustable shelving. The scope of the invention should, therefore, be determined with reference to the appended claims, along with the full scope of equivalents to which such claims are entitled.

What is claimed is:

1. An adjustable shelving apparatus for use with organization systems, the shelving apparatus comprising:

a first sliding member having a housing defining an enclosed space and a plurality of projections extending therein, the housing having at least one open end; and a second sliding member having a plurality of cut outs therein, the second sliding member adapted to be received through the open end and within the enclosed space of the first sliding member such that the projections are engaged by the cut outs.

2. The adjustable shelving apparatus as recited in claim 1, wherein the first sliding member and the second sliding member have an oval shape.

3. An adjustable shelving apparatus comprising:

a first sliding member comprising a first housing having a first length, the first housing comprising an inner surface and an outer surface, the inner surface defining at least one projection extending substantially the length of the first housing; and a second sliding member comprising a second housing having a second length, the second housing defining at least one slot extending substantially the length of the second sliding member, each slot defined to receive in nesting fashion one of said at least one projection, wherein the first sliding member is adapted to telescopically receive the second sliding member, and the at least one projection is slidably received within the at least one slot.

4. The adjustable shelving apparatus as recited in claim 3, wherein the first sliding member comprises a plurality of projections in parallel relationship, and the second sliding member defines a plurality of slots in parallel relationship.

5. The adjustable shelving apparatus as recited in claim 3, wherein each of the first and second housings comprises a substantially rectangular cross-section.

6. The adjustable shelving apparatus as recited in claim 3, wherein the first and second housings comprise a substantially oval cross-section.

* * * * *